United States Patent [19]

Cartabbia

[11] Patent Number: 5,040,776

[45] Date of Patent: Aug. 20, 1991

[54] AUTOMATICALLY OPERATING SYSTEM FOR TAKING UP AND DISCHARGING CLOTH ARTICLES OR PORTIONS THEREOF FROM IRONING APPARATUS

[76] Inventor: Giovanni Cartabbia, Via Fusline, 36, 25036 Palazzolo Sull'Oglio (Brescia), Italy

[21] Appl. No.: 496,891

[22] Filed: Mar. 21, 1990

Related U.S. Application Data

[63] Continuation of Ser. No. 129,156, Dec. 7, 1987, abandoned.

[30] Foreign Application Priority Data

Jul. 16, 1987 [IT] Italy ..... 21326 A/87

[51] Int. Cl.[5] ..... B65H 5/00

[52] U.S. Cl. ..... 271/1; 271/85; 38/7; 901/32; 901/39; 414/732; 414/740; 294/106

[58] Field of Search ..... 271/1, 18.3, 84, 85, 271/264, 267, 268, 278; 38/7, 12, 143; 294/88, 103.1, 104, 106; 901/15, 21, 22, 31, 32, 39; 414/680, 729, 732, 738

[56] References Cited

U.S. PATENT DOCUMENTS

| | | | |
|---|---|---|---|
| 3,631,989 | 1/1972 | McCornick | 901/22 |
| 3,701,328 | 10/1972 | Frost | 271/1 |
| 4,602,462 | 7/1986 | Anderson | 414/680 |

*Primary Examiner*—H. Grant Skaggs
*Attorney, Agent, or Firm*—Bucknam and Archer

[57] ABSTRACT

A system for taking up and discharging ironed cloth articles from ironing apparatus comprises a column mounted on a base and supporting an articulated rotary arm at one end of which there is mounted a ball member for engaging an ironed cloth article and removing it from an ironing apparatus.

1 Claim, 7 Drawing Sheets

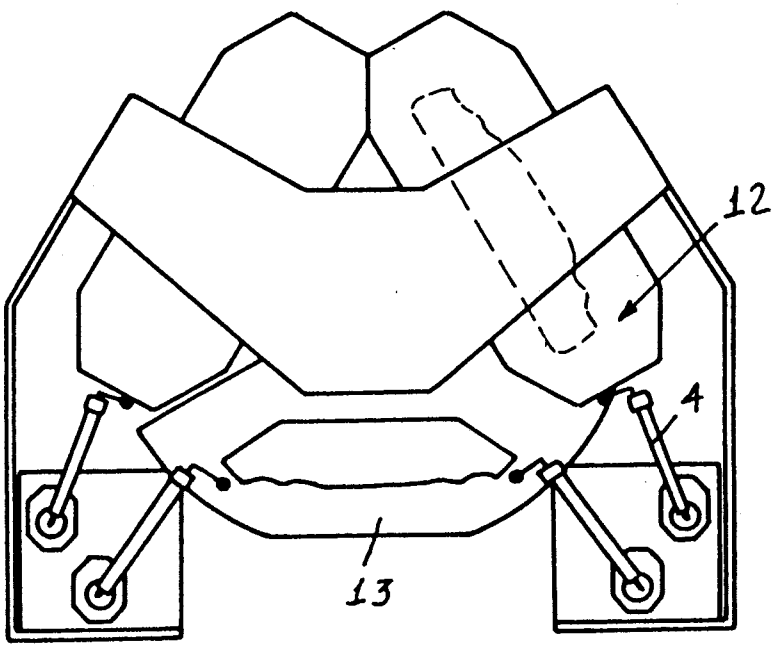
Fig. 3
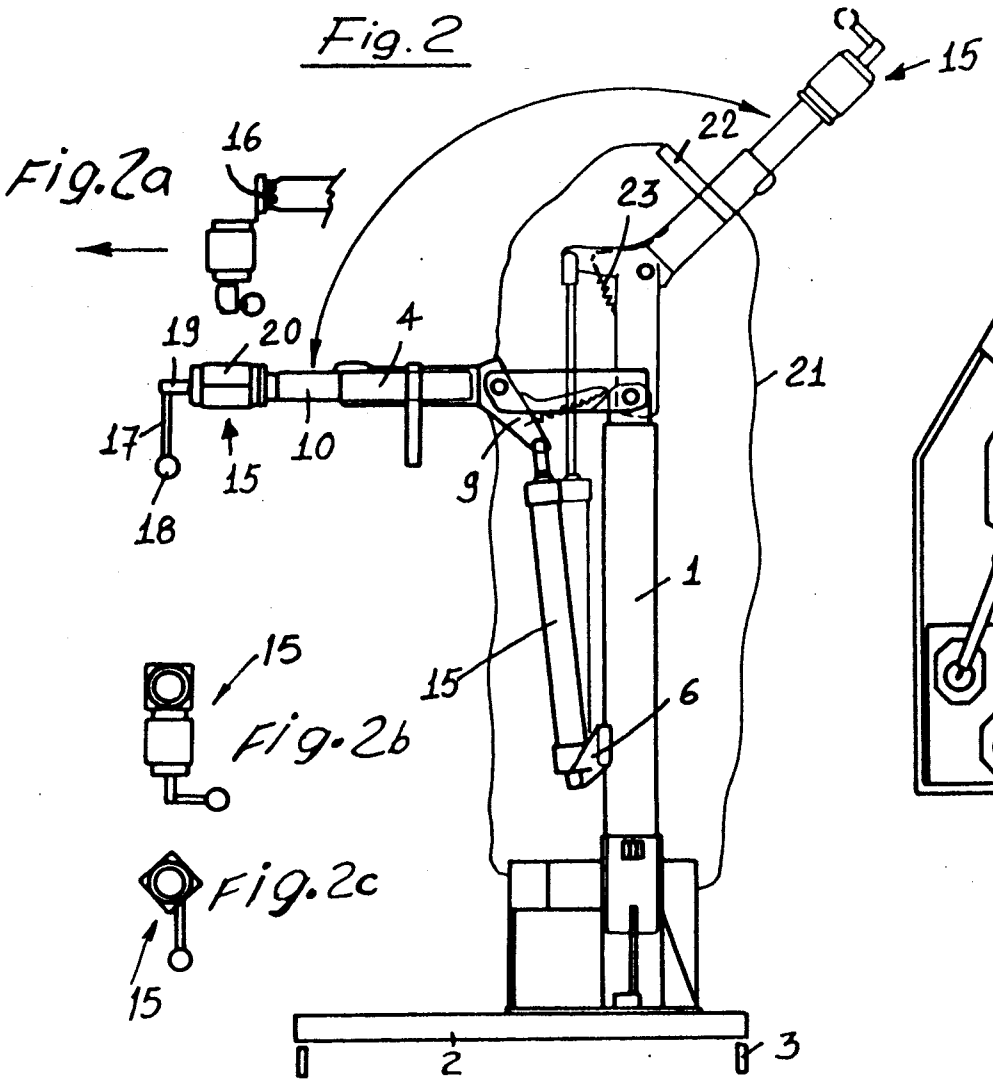
Fig. 2
Fig. 2a
Fig. 2b
Fig. 2c

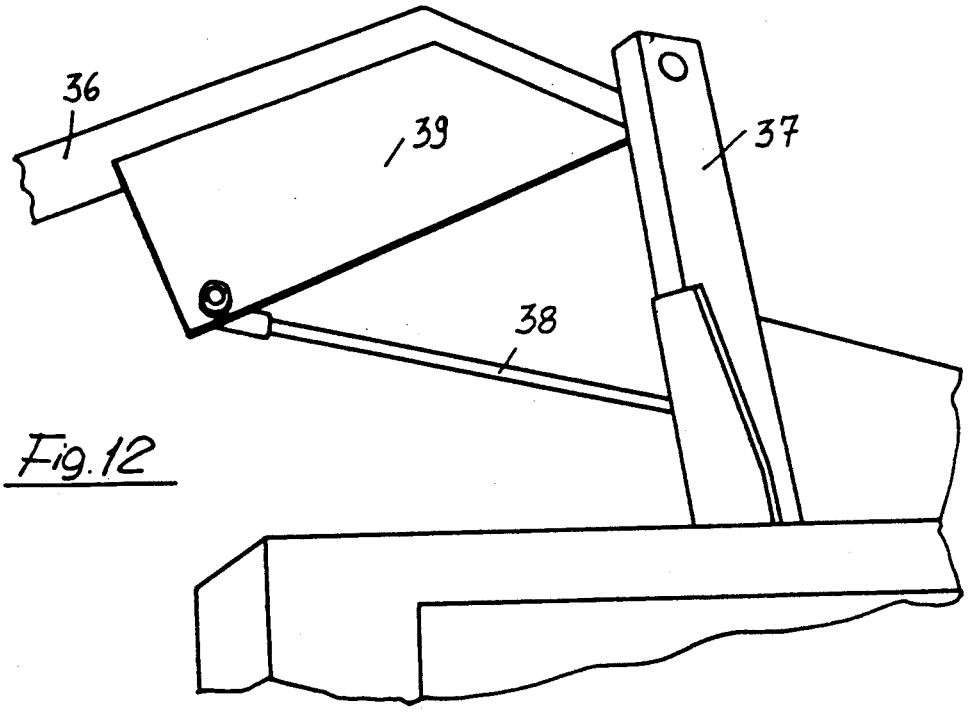
Fig. 12
Fig. 13
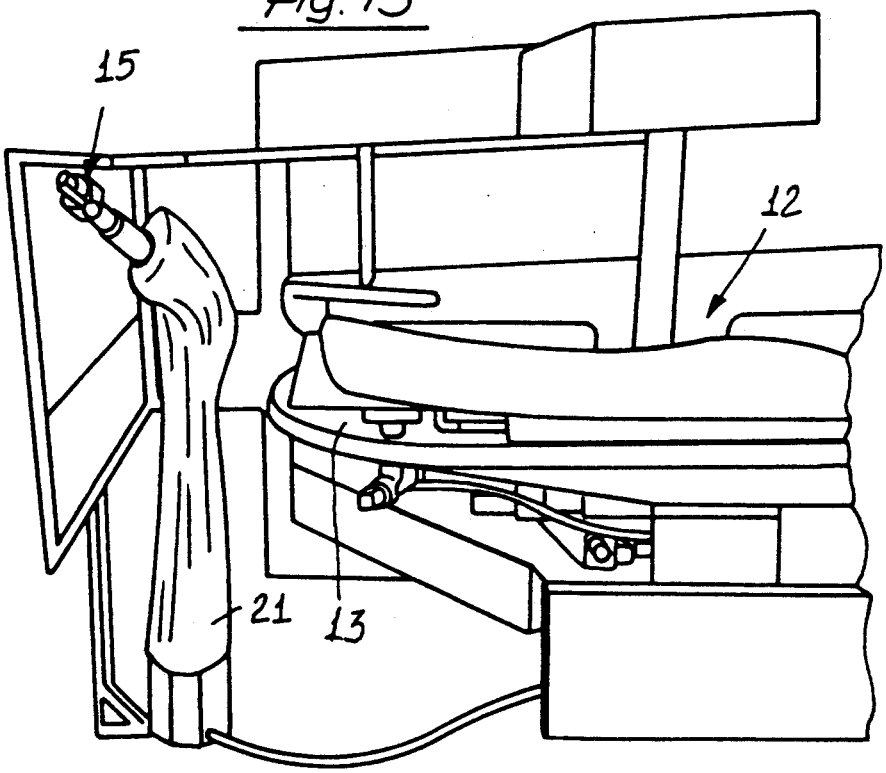

AUTOMATICALLY OPERATING SYSTEM FOR TAKING UP AND DISCHARGING CLOTH ARTICLES OR PORTIONS THEREOF FROM IRONING APPARATUS

This is a continuation, of application Ser. No. 129,156, filed Dec. 7, 1987, now abandoned.

BACKGROUND OF THE INVENTION

The present invention relates to an automatically operating system for taking up and discharging cloth articles, in particular jackets, from ironing apparatus.

As is known, in the cloth article making industry there is usually provided and end ironing operation, which is carried out by suitable ironing apparatus.

This ironing apparatus are able of operating with very high rates, but, presently, they are not completely exploited because of the time required for discharging the ironed cloth articles from said apparatus.

This requirement of discharging from ironing apparatus the ironed cloth articles moreover requires the use of personnel which, even if it is not specialized personnel, causes the finished articles cost to be remarkably increased.

SUMMARY OF THE INVENTION

Accordingly, the main object of the present invention is to overcome the above mentioned drawbacks, by providing a system for taking up and discharging cloth articles from ironing apparatus, which system is able of automatically operating.

Another object of the present invention is to provide a system for automatically taking up and discharging cloth articles from ironing apparatus, which comprises a cloth article engaging member having a shape which has been specifically designed depending on requirements.

Another object of the present invention is to provide such a system for taking up and discharging cloth articles from ironing apparatus which is highly reliable and can operate in a very flexible way.

According to one aspect of the present invention, the above mentioned objects, as well as yet other objects, which will become more apparent thereinafter, are achieved by a system for taking up and discharging cloth articles from ironing apparatus, characterized in that it essentially comprises a column, mounted on a base and supporting an articulated arm, adapted for assuming a horizontal attitude and rotating, for a given angle, in its vertical laying plane, at one end of said articulated arm there being mounted a shaped member adapted for engaging and/or taking up an ironed cloth article.

BRIEF DESCRIPTION OF THE DRAWINGS

Further characteristics and advantages of the system for taking up and discharging cloth articles from ironing apparatus, according to the present invention, will become more apparent from the following detailed disclosure of some preferred embodiments of said system, which are illustrated, by way of a merely indicative example, in the figures of the accompanying drawings, where:

FIG. 2 illustrates a variation of the system according to the invention, provided with its cloth article engaging rotating arm;

FIGS. 2A to 2C schematically show other possible position assumed by the cloth engaging member.

FIG. 3 illustrates a procedure for using several embodiments of the subject system as perimetrically arranged with respect to a rotating table supporting ironing means and represented by a top schematic view;

FIG. 12 is a detail view illustrating a preferred way for coupling in an articulated way the articulated arm supporting the cloth article engaging member illustrated in FIG. 9; and FIG. 13 illustrates a portion of a rotating ironing table adjoining the ironed cloth article discharging system according to the invention.

DESCRIPTION OF THE PREFERRED EMBODIMENTS

Figure 1:
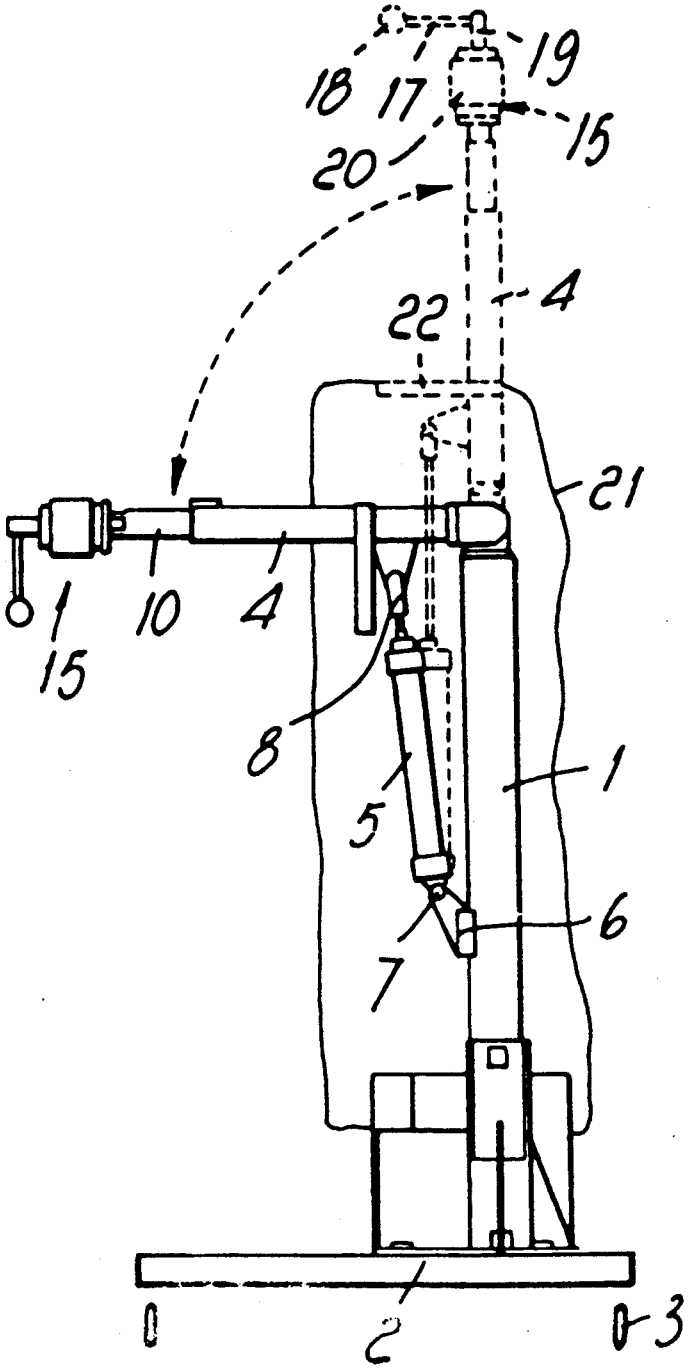
FIG. 1 illustrates several views and arrangements of the system according to the invention including a cloth article taking up or engaging member consisting of a rotating arm.
Figure 1A:
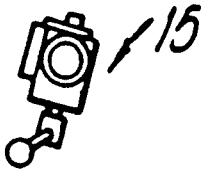
FIGS. 1A to 1E schematically show possible positions assumed by the cloth engaging member.
Figure 1B:
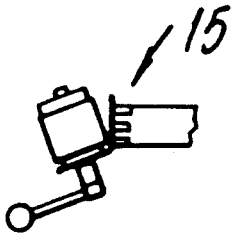
Figure 1C:
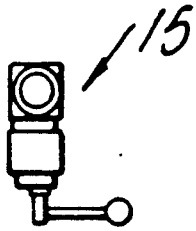
Figure 1D:
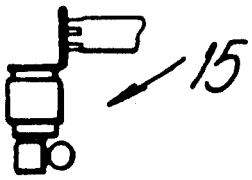
Figure 1E:
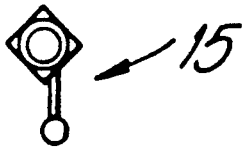
Figure 4:
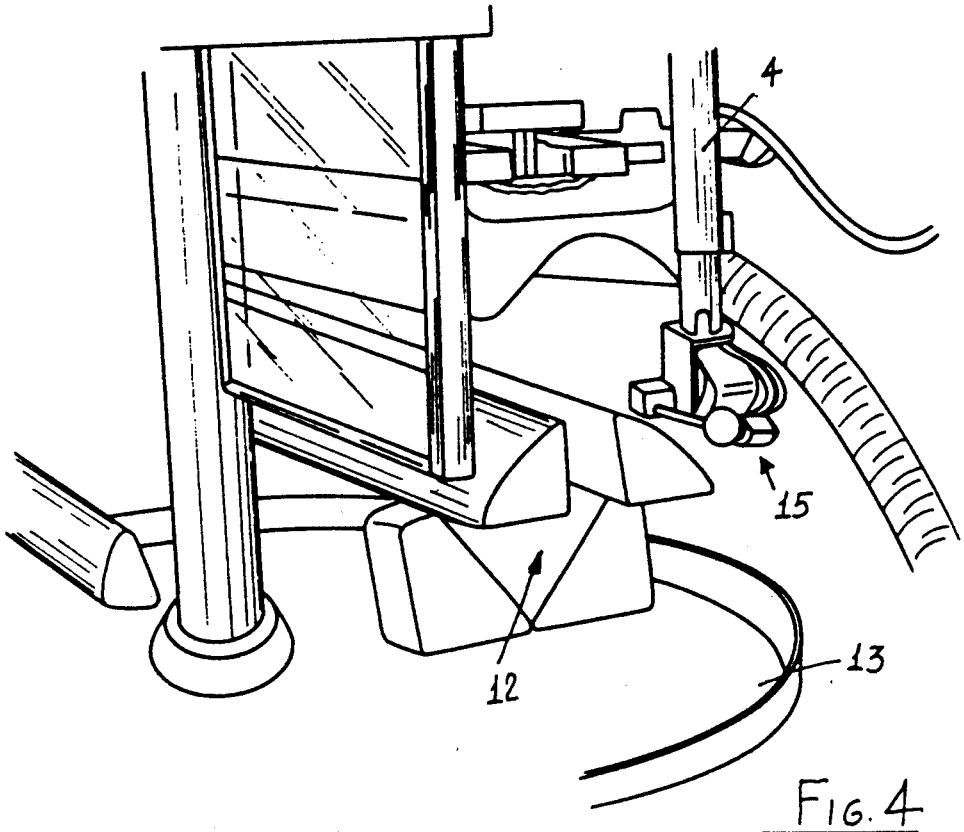
FIGS. 4 and 5 illustrate an articulated arm adjoining an ironing apparatus, respectively in a rest position and in a cloth article engaging position.
Figure 5:
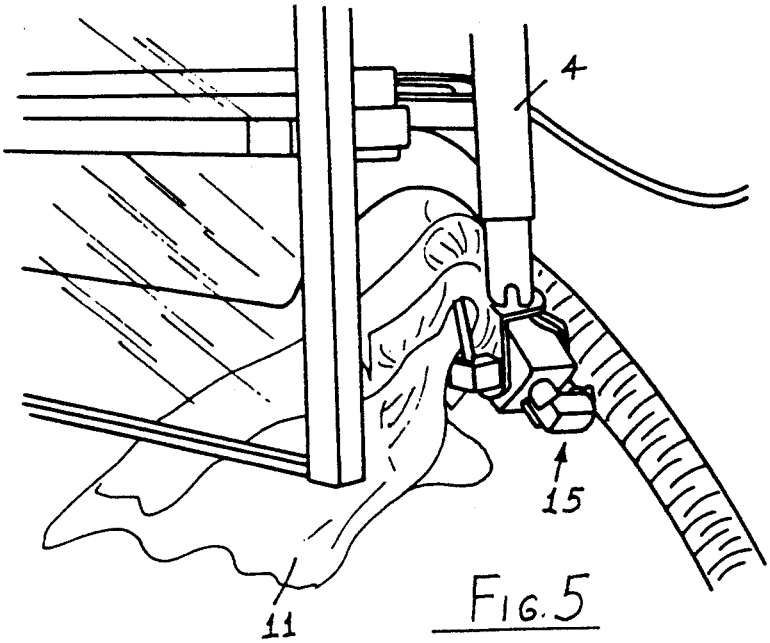
Figure 6:
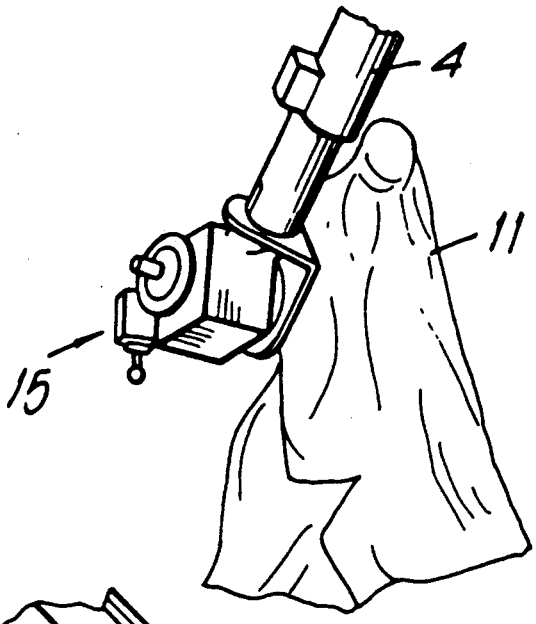
FIG. 6 illustrates another step for discharging the mentioned ironed cloth article.

With reference to the Figures of the accompanying drawings, the system for taking up and discharging cloth articles from ironing apparatus, according to the invention, comprises, in a preferred embodiment thereof, a column 1 which is mounted on a base 2 having resting feet 3 which may be adjusted in the height direction.

At the top of the mentioned column there is articulated an arm 4 able of rotating, in its vertical laying plane, by means of a cylinder 5.

This cylinder is coupled to the column by means of a supporting member 6 and a pivot pin 7 and it is coupled to the mentioned arm through a fork member 8, as shown in FIG. 1, or through a middle lever 9, as shown in FIG. 2.

At the end portion of the mentioned articulated arm there is mounted, possibly through the interposition of a suitable coupling member 10, a cloth engaging member, adapted for taking up and discharging a cloth article 11 which has been ironed by the apparatus 12 mounted on the rotating table 13, or by means of a pressing apparatus 14 or the like.

More specifically, a cloth engaging member, indicated overally at 15, is provided, which is affixed to the coupling member 10 through a crank bracket 16 and which consists of a small arm 17 ending with a ball 18, and radially mounted on the shaft 19 of a hydraulic or the like driving member or motor 20.

It should be pointed out that said crank bracket may be mounted on the column of FIG. 1 (as shown from the top to the bottom in this Figure) at 110°, 90° or according to a conventional configuration and, on the column of FIG. 2 at 90° or according to a conventional configuration; the mentioned columns, moreover, are preferably covered by a covering member or fabric 21 which is supported by a disc shaped member 22 radially fixed to the arm 4.

Moreover, the arm of the column shown in FIG. 1 may assume a horizontal arrangement and a vertical arrangement or attitude, upwardly directed, with a rotation through 90°, whereas the arm shown in FIG. 2, may upwardly rotate through an arc of 135°, and is coupled to said column also through a pulling spring 23.

Figure 7:
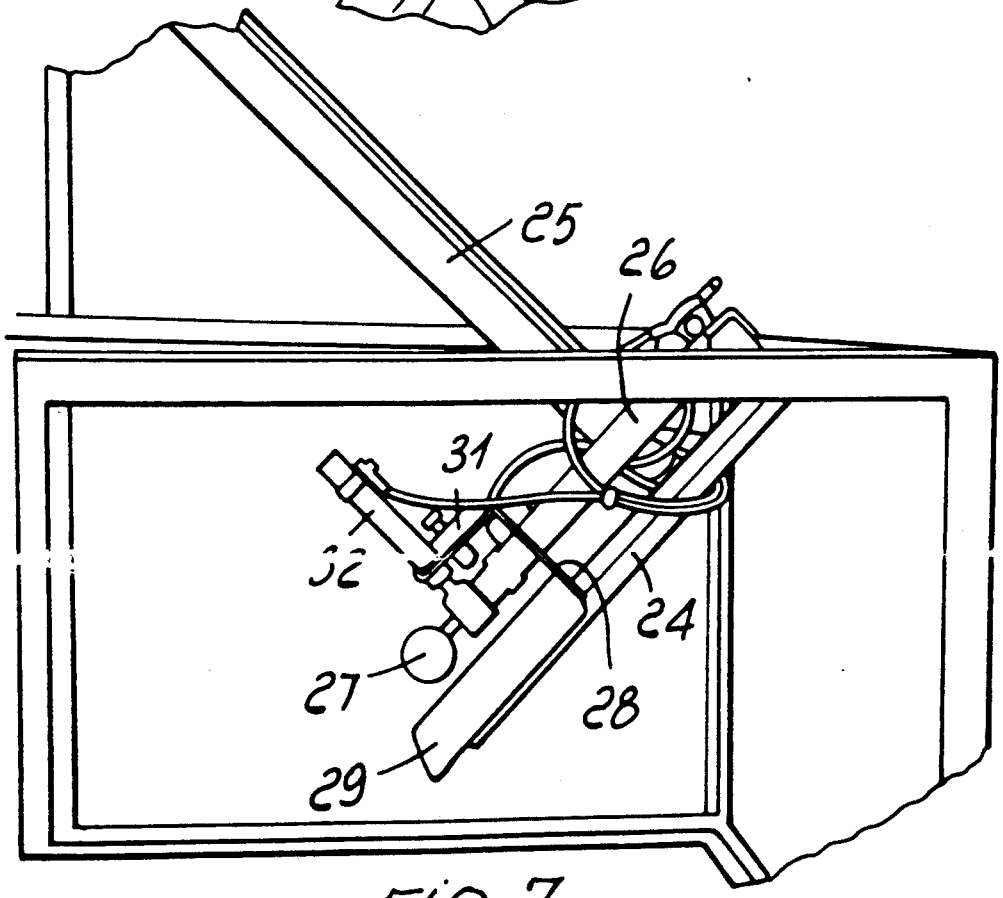
FIG. 7 illustrates a variation of the cloth article engaging member, mounted at one end of the mentioned articulated arm.
Figure 8:
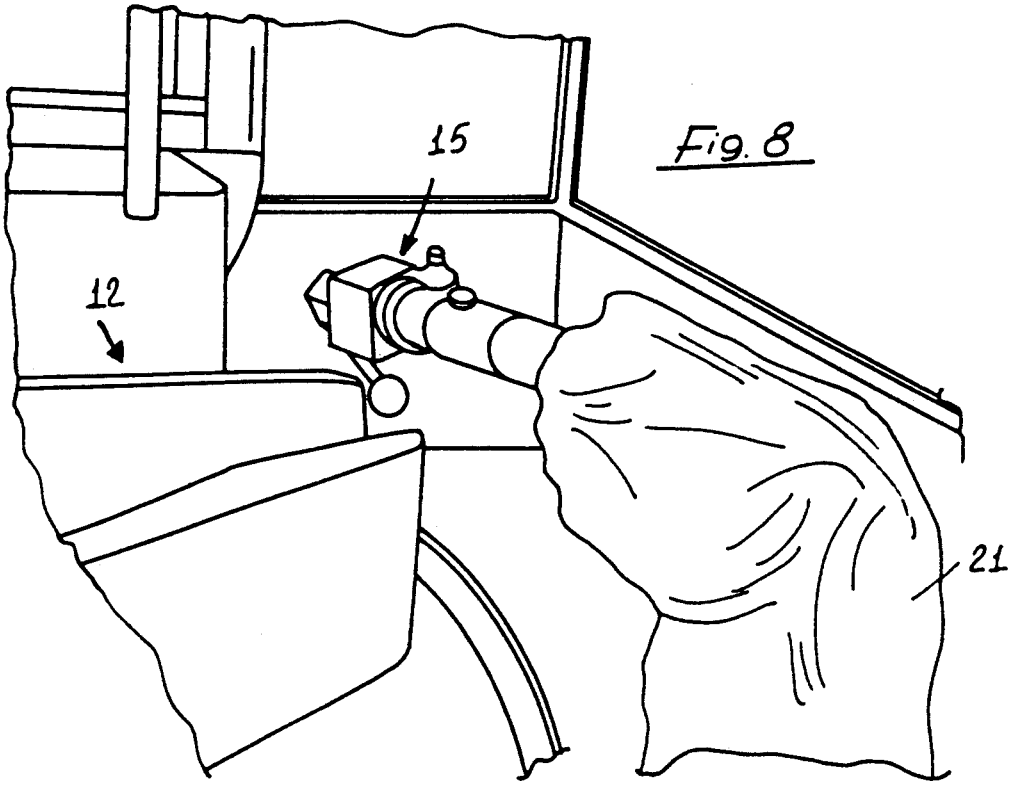
FIG. 8 is another view of the above mentioned articulated arm, represented in an ironed cloth article taking up condition.
Figure 9:
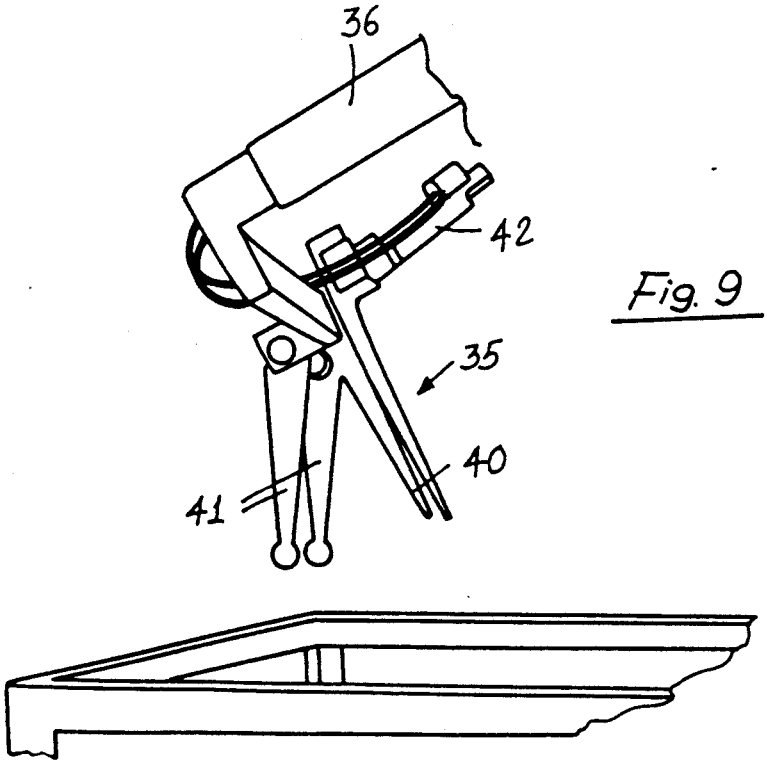
FIG. 9 illustrates yet another variation of the cloth article engaging member, mounted at the end of the articulated arm.
Figure 10:
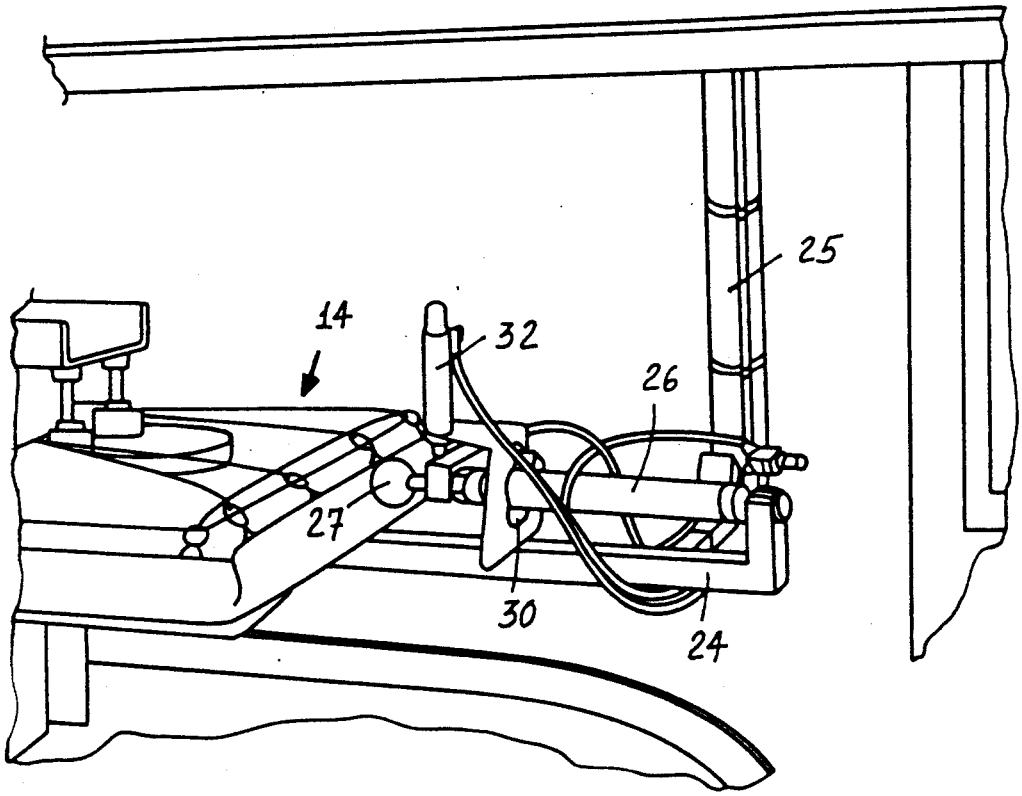
FIG. 10 is a further view illustrating the cloth article engaging member represented in FIG. 7.
Figure 11:
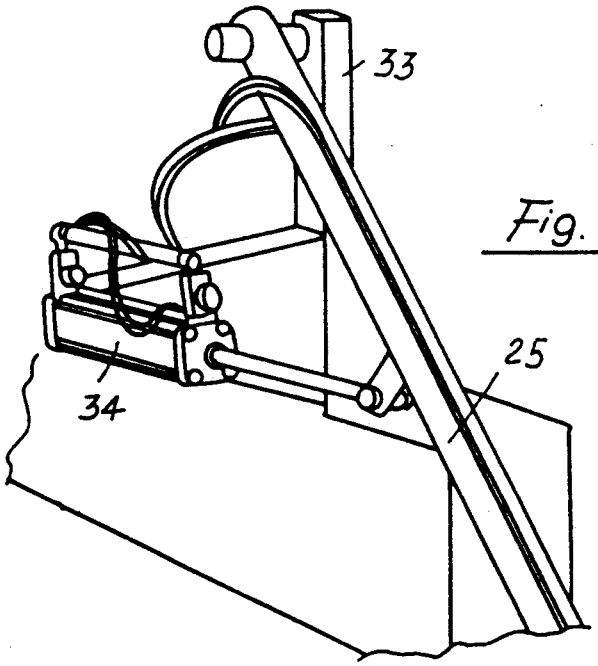
FIG. 11 illustrates a practical embodiment of the mentioned articulated arm.

According to a variation, the cloth article engaging member (as shown in FIGS. 7 and 10) consists of a crank bracket structure 24 cantilever-wise mounted on an articulated arm 25.

This crank bracket structure supports, in an articulated way parallely to its longitudinal direction, a cylinder 26 which is provided, at the end of its rod, with a ball 27.

On that same structure, moreover, there is provided a further bracket element 28 (see FIG. 7), having a surface 29 which parallely extends to the mentioned cylinder; an elongated slot 30, for allowing for said cylinder to pass through, and a top lug 31 for coupling a further cylinder 32.

The thus constituted member is able of engaging the cloth article by pressing a portion of said cloth articles to be discharged between the ball 27, suitably driven and located by the cylinders 26 and 32, and the surface 29.

More specifically, the arm 25 is pivoted to a upright 33 and rotatively driven by a double acting cylinder 34.

According to a further variation, the cloth engaging member may consist of a pliers member, indicated overally at 35, which is mounted, cantilever-wise, at the end of an arm 36, which is articulated, at the opposite end, bent with an obtuse angle, to a further upright 37.

This arm is driven through the rod 38 of a further cylinder (not shown) pivoted at the outer vertex of a plate 39 which is affixed in the dihedral portion defined by its angled part.

The mentioned pliers element, in particular, consists of two fixed lugs 40 which cooperate with a movable jaw pair 41, in turn driven by a double acting cylinder 42.

It should be apparent that the system according to the present invention, would be able of taking up and discharging cloth article portions, in a not finished condition, during a processing step thereof.

From the above disclosure and accompanying drawings the great use facility characterizing the system for automatically taking up and discharging cloth articles from ironing apparatus, according to the present invention, will be self-evident.

While some preferred embodiments of the system according to the invention have been thereinabove disclosed and illustrated, it should be apparent that the disclosed embodiments are susceptible to many modifications and variations all of which enter within the scope of the appended claims.

I claim:

1. A system for taking up and discharging cloth articles from ironing apparatus, comprising an adjustable height column mounted on a base and supporting at a top portion thereof an extending articulated rotary arm at one end of said articulated arm there being mounted a hydraulic motor having a shaft, a cloth article engaging arm coupled to said shaft of said hydraulic motor, said cloth article engaging arm having a ball shaped end, a crank bracket for coupling said cloth engaging arm to said articulated arm, an operating cylinder for rotatively reciprocating said articulated arm, said cylinder having a cylinder rod movable from a fully retracted position to a fully extended position, said cylinder having a bottom portion pivotally coupled to said column, linkage means for coupling said rod to a portion of said articulated arm near said column so as to displace said articulated arm, as said operating cylinder is actuated, from a substantially horizontal position through a displacement range of substantially 135°.

* * * * *